US006840437B2

(12) United States Patent
Chen

(10) Patent No.: US 6,840,437 B2
(45) Date of Patent: Jan. 11, 2005

(54) BOX FORMED FROM A FOLDABLE BLANK SHEET

(75) Inventor: Waterson Chen, Taichung (TW)

(73) Assignee: Waterson Corp., Taichung City (TW)

( * ) Notice: Subject to any disclaimer, the term of this patent is extended or adjusted under 35 U.S.C. 154(b) by 0 days.

(21) Appl. No.: 10/376,684

(22) Filed: Feb. 28, 2003

(65) Prior Publication Data

US 2004/0169067 A1 Sep. 2, 2004

(51) Int. Cl.[7] ..... B65D 25/04
(52) U.S. Cl. ..... 229/120.17; 229/147; 229/172
(58) Field of Search ..... 229/120.17, 147, 229/172, 117.18

(56) References Cited

U.S. PATENT DOCUMENTS 3,014,633 A * 12/1961 Tarmina ..... 229/154
3,301,461 A * 1/1967 Kroeschell ..... 229/117.17
3,510,047 A * 5/1970 Boehm et al. ..... 229/147
3,854,651 A * 12/1974 Osborne ..... 229/160
3,889,868 A * 6/1975 Bruckner et al. ..... 229/125
4,257,550 A * 3/1981 Frohlicher ..... 229/102
4,511,079 A * 4/1985 Lopez ..... 229/101
5,007,580 A * 4/1991 Morrison et al. ..... 229/117.17
5,236,122 A * 8/1993 Ballard ..... 229/102
5,476,218 A * 12/1995 Reisman ..... 229/123
6,547,126 B2 * 4/2003 Freiborg et al. ..... 229/120.17

* cited by examiner

*Primary Examiner*—Tri M. Mai
(74) *Attorney, Agent, or Firm*—Ohlandt, Greeley, Ruggiero & Perle L.L.P.

(57) ABSTRACT

A box formed from a foldable blank sheet includes a bottom panel, left and right panels, front and rear panels, and a top panel. A left reinforcing panel is hinged to the left panel and lies against a left portion of the bottom panel. A right reinforcing panel is hinged to the right panel and lies against a right portion of the bottom panel.

4 Claims, 14 Drawing Sheets

BOX FORMED FROM A FOLDABLE BLANK SHEET

BACKGROUND OF THE INVENTION

1. Field of the Invention

This invention relates to a box, more particularly to a box formed from a foldable blank sheet that is cut and scored and that is folded into the box.

2. Description of the Related Art

FIGS. 1 and 2 illustrate a conventional box 1 formed from a foldable blank sheet of paper board. The box 1 includes a bottom panel 11, front and rear panels 12, 14 hinged to and folded respectively from front and rear sides of the bottom panel 11, left and right panels 16, 17 hinged to and folded respectively from left and right sides of the bottom panel 11, and a pair of top panels 13, 15 hinged to and folded respectively from the front and rear panels 12, 14. The aforesaid conventional box 1 is disadvantageous in that the mechanical strength thereof is relatively weak such that the box 1 is not suitable for storing heavy products.

FIG. 3 illustrates another conventional box 2 with a box body 20 and a hanging member 21 that is formed with a through-hole 22 for hanging purposes. Since the hanging member 21 is not retractable, storing and transport of a large quantity of the conventional boxes 2 are relatively inconvenient, and extra space is required to accommodate the hanging members 21 of the boxes 2.

SUMMARY OF THE INVENTION

Therefore, the object of the present invention is to provide a box that is capable of overcoming the aforementioned drawbacks of the prior art.

According to the present invention, there is provided a box that is formed from a foldable blank sheet which is cut and scored and which is folded into the box. The box comprises: a bottom panel with left and right sides and front and rear sides, the bottom panel having left and right portions; a front panel hinged to the front side of the bottom panel and extending therefrom in a first transverse direction relative to the bottom panel; a rear panel hinged to the rear side of the bottom panel, extending therefrom in the first transverse direction, and having left and right sides and a top side that is opposite to the rear side of the bottom panel; a left side panel hinged to the left side of the rear panel and extending therefrom in a second transverse direction relative to the front and rear panels, the left side panel having a bottom side abutting against the left side of the bottom panel; a right side panel hinged to the right side of the rear panel and extending therefrom in the second transverse direction, the right side panel having a bottom side abutting against the right side of the bottom panel; a left reinforcing panel hinged to the bottom side of the left side panel and extending therefrom in a third transverse direction relative to the left side panel to lie against the left portion of the bottom panel, the left reinforcing panel having a free end that is opposite to the left side of the bottom panel; a right reinforcing panel hinged to the bottom side of the right side panel and extending therefrom in the third transverse direction to lie against the right portion of the bottom panel, the right reinforcing panel having a free end that is opposite to the right side of the bottom panel and that abuts against the free end of the first left reinforcing panel; a top panel hinged to the top side of the rear panel and extending therefrom in the second transverse direction; and an interlocking unit for securing the top panel to the front panel and the left and right side panels.

BRIEF DESCRIPTION OF THE DRAWINGS

In drawings which illustrate an embodiment of the invention.

DETAILED DESCRIPTION OF THE PREFERRED EMBODIMENT

FIGS. 4 to 14 illustrate a preferred embodiment of a box 3 according to this invention. The box 3 is formed from a foldable blank sheet of paper board which is cut and scored and which is folded into the box 3.

Figure 1:
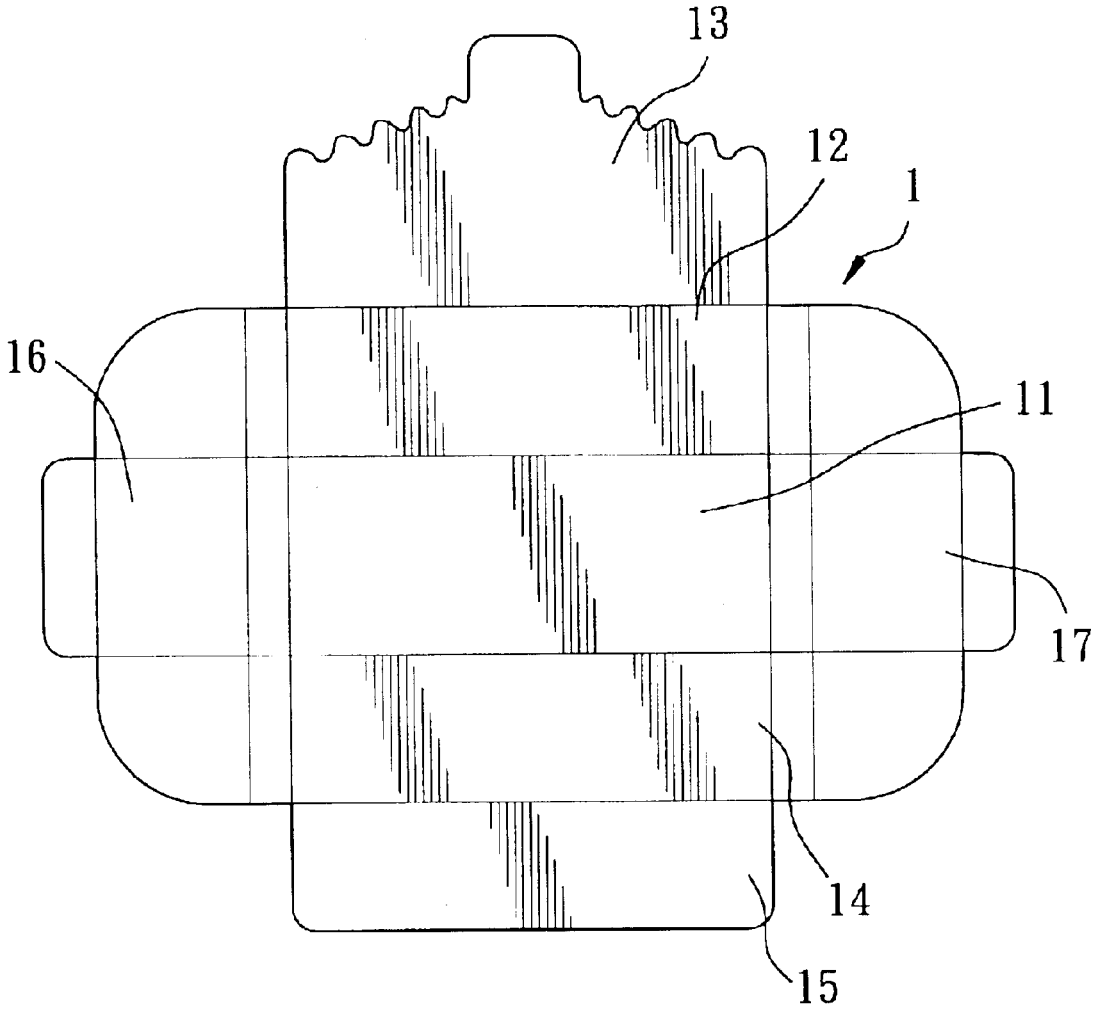
FIG. 1 PRIOR ART
FIG. 1 is a plan view of a conventional box in an unfolded state.
Figure 2:
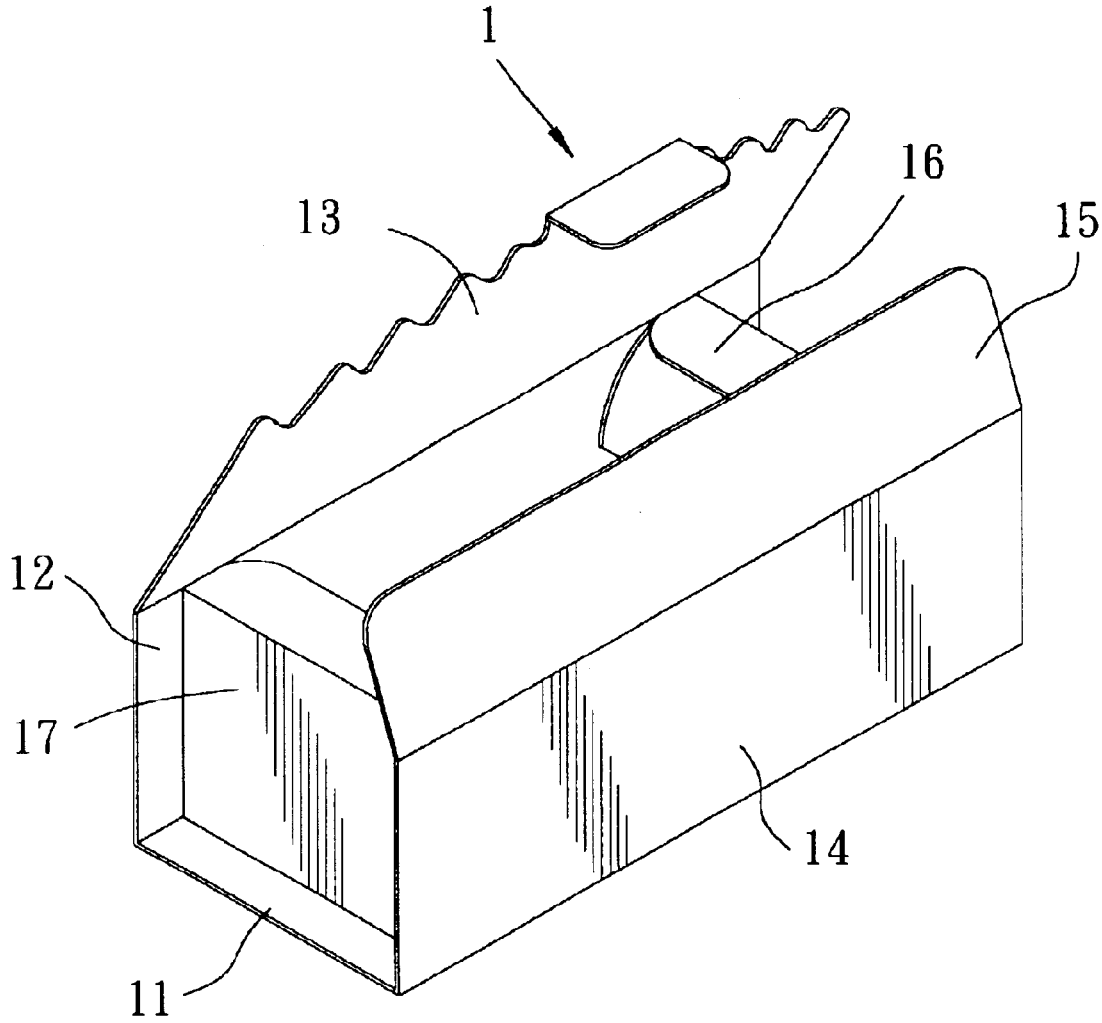
FIG. 2 PRIOR ART
FIG. 2 is a perspective view of the box of FIG. 1 in a folded state.
Figure 3:
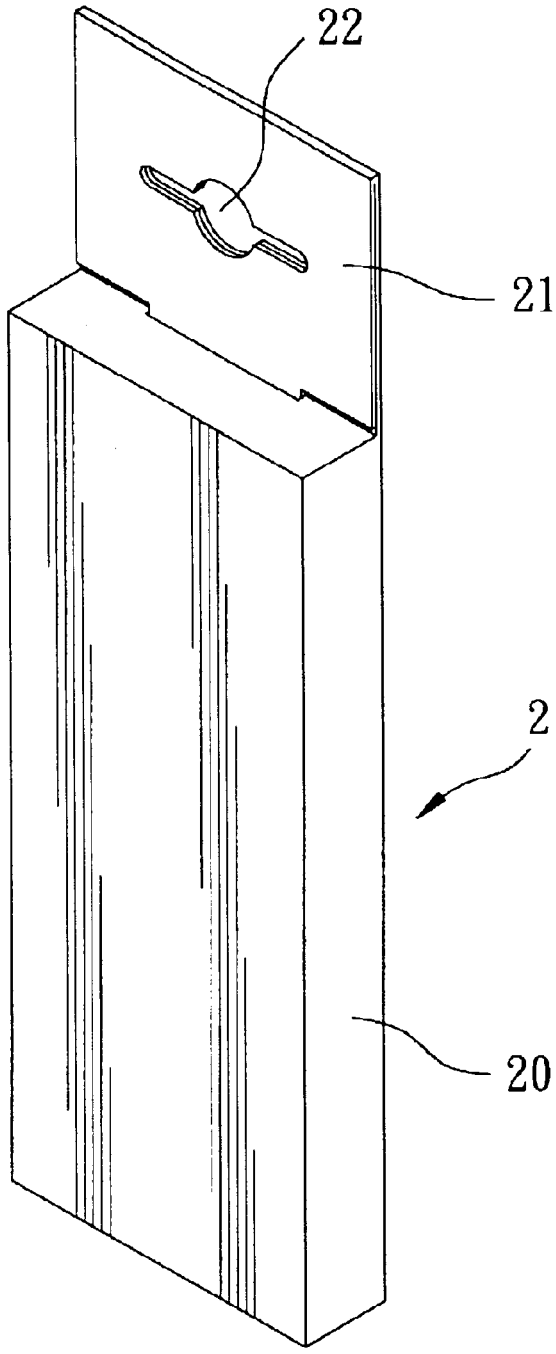
FIG. 3 PRIOR ART
FIG. 3 is a perspective view of another conventional box with a hanging member.
Figure 4:
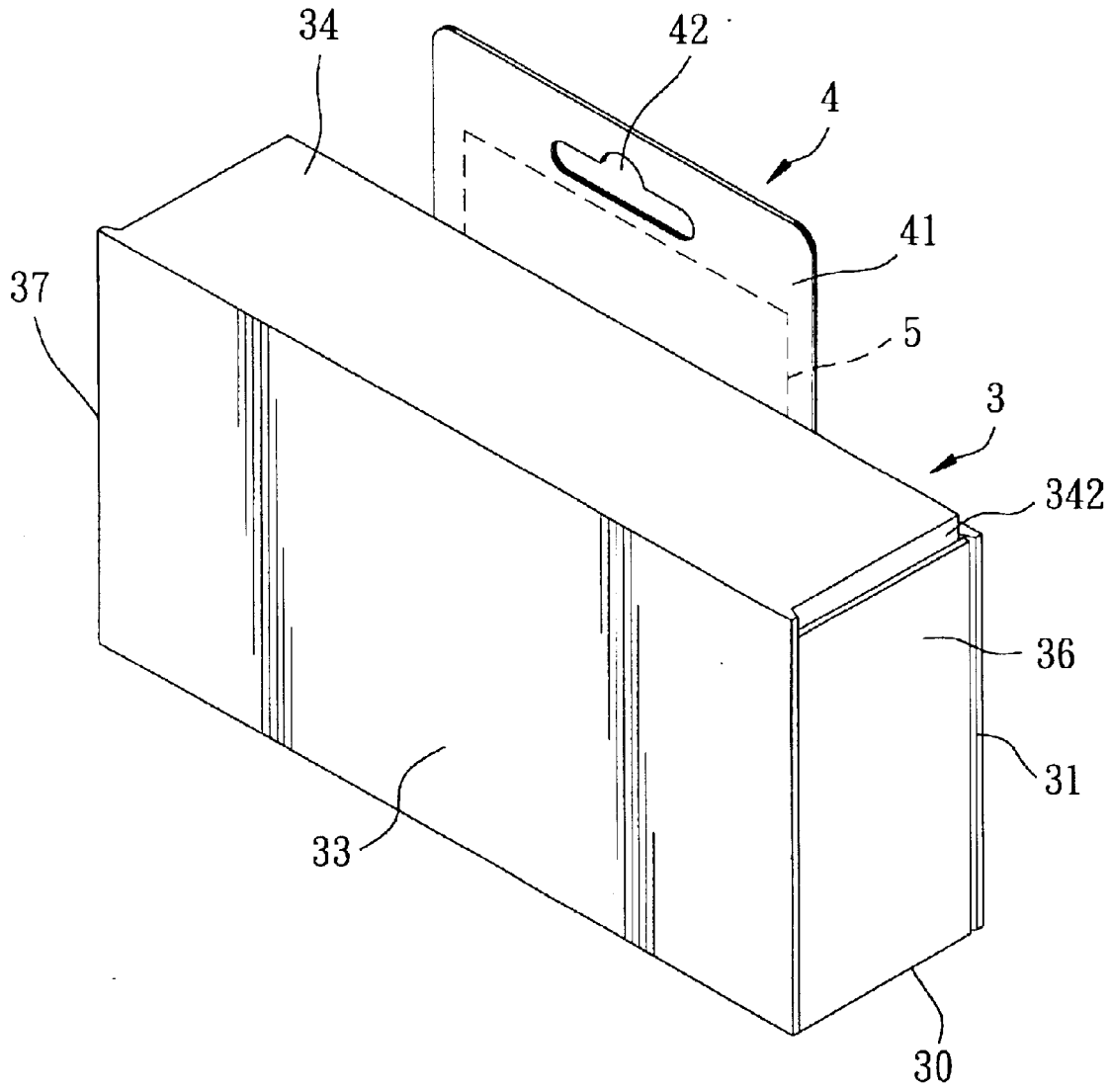
FIG. 4 is a perspective view of a box embodying this invention.
Figure 5:
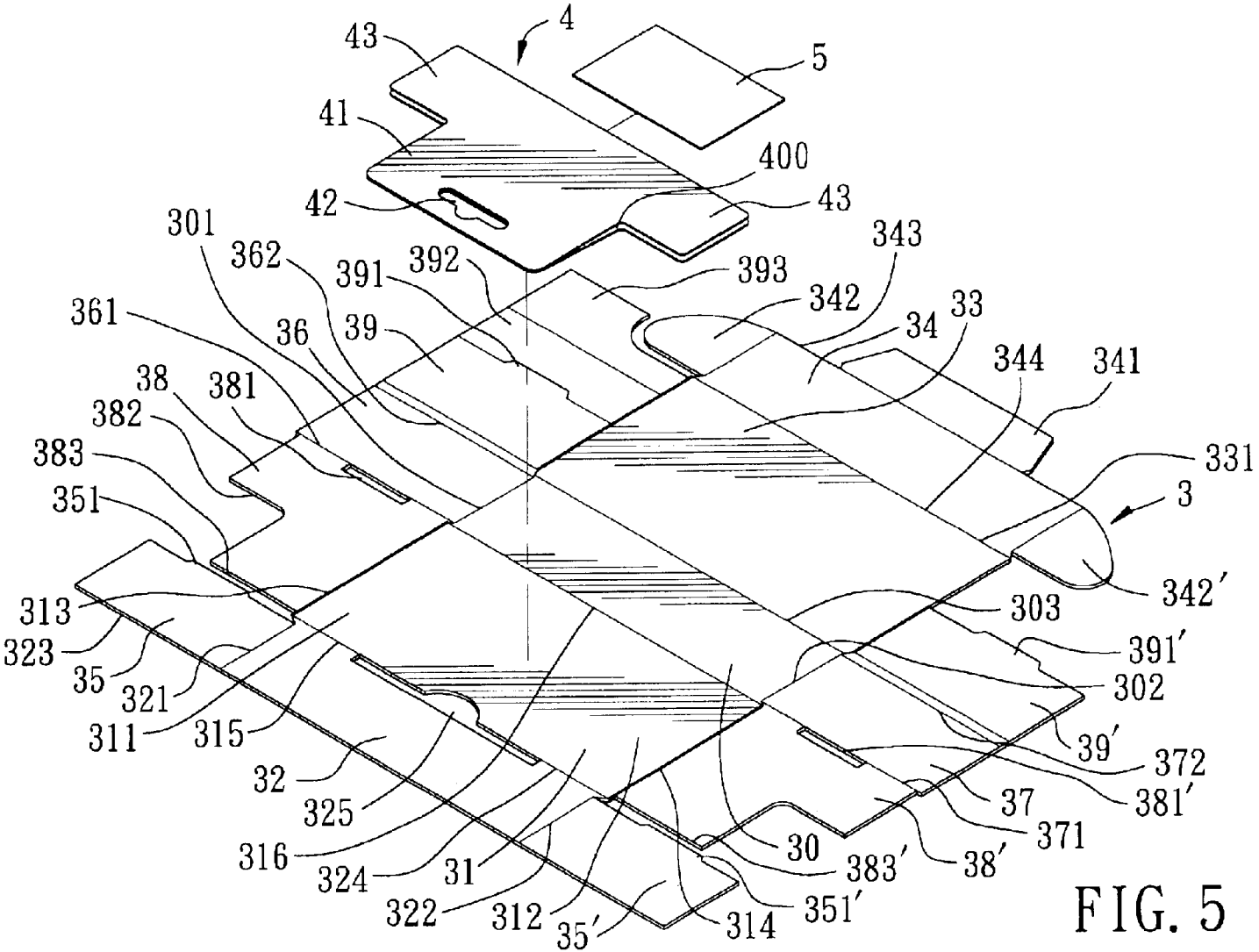
FIG. 5 is an exploded view of the box of FIG. 4 in an unfolded state.
Figure 6:
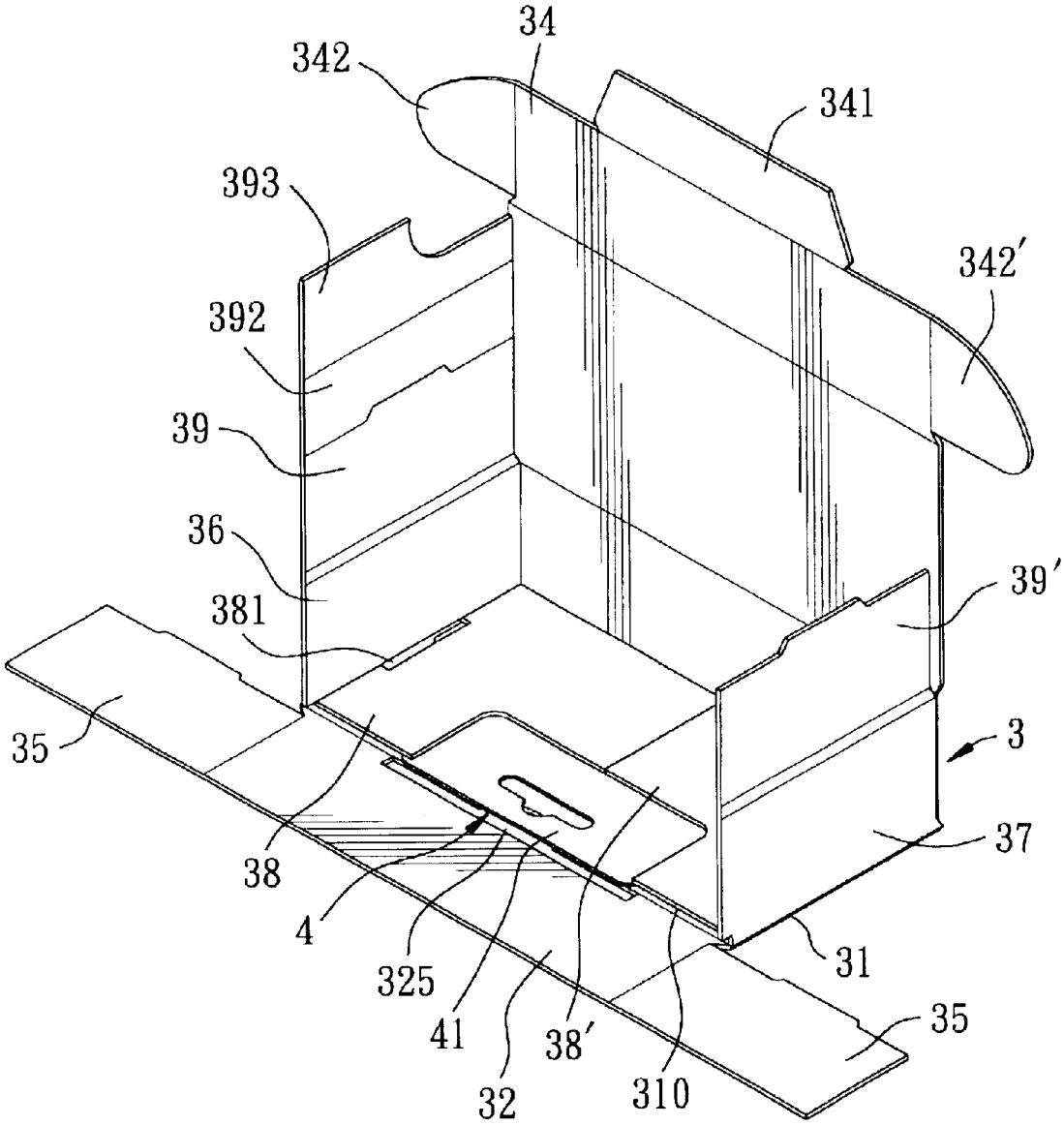
FIG. 6 is a perspective view to illustrate how a pair of reinforcing panels are folded to lie against a bottom panel of the box of FIG. 4.
Figure 7:
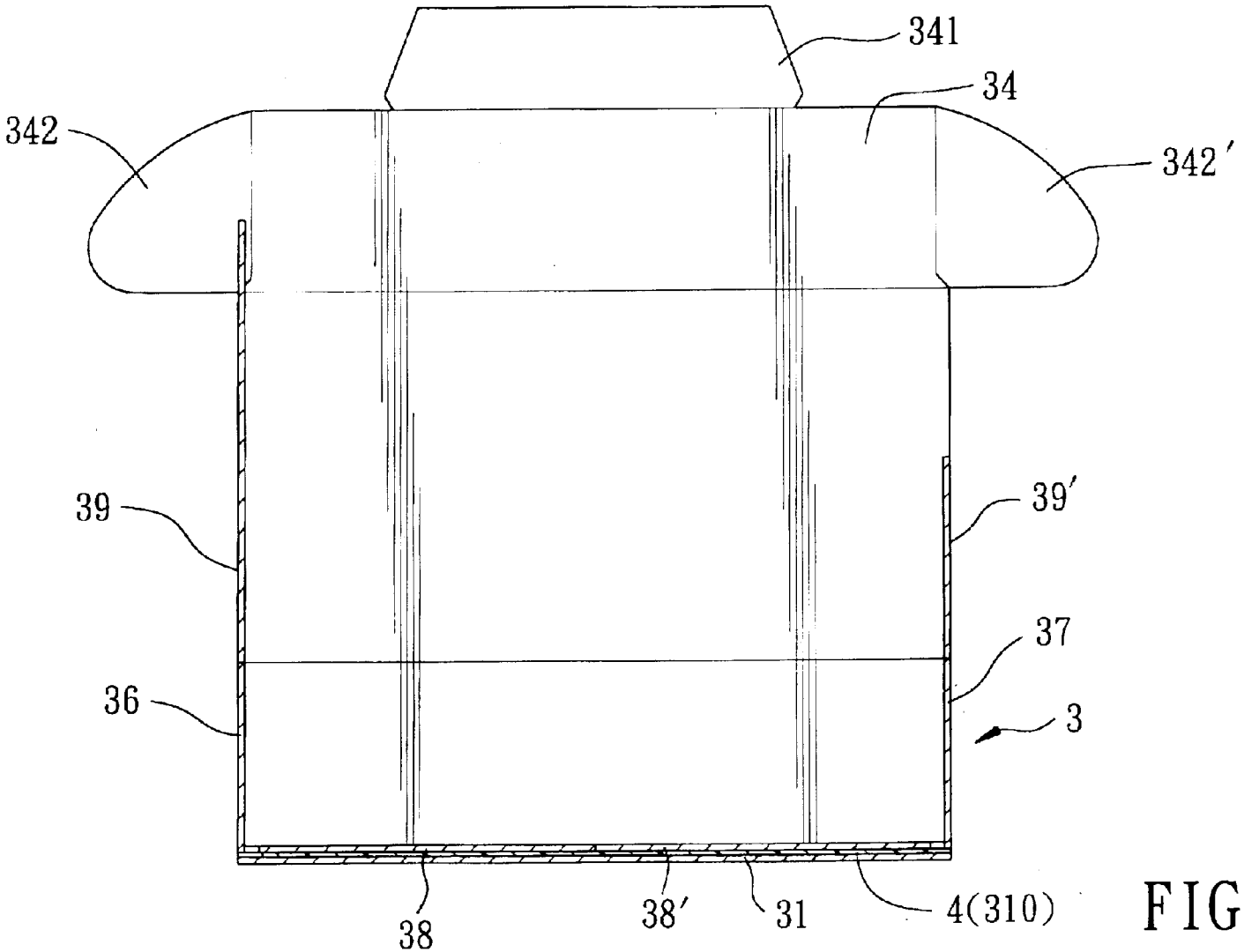
FIG. 7 is a sectional front view of FIG. 6.

Referring to FIGS. 6 and 7, in combination with FIGS. 4 and 5, the box 3 includes: a bottom panel 31 with left and right sides 313, 314 and front and rear sides 315, 316, the bottom panel 31 having left and right portions 311, 312; a front panel 32 hinged to the front side 315 of the bottom panel 31 and extending therefrom in a first transverse direction relative to the bottom panel 31; a rear panel 30 hinged to the rear side 316 of the bottom panel 31, extending therefrom in the first transverse direction, and having left and right sides 301, 302 and a top side 303 that is opposite to the rear side 316 of the bottom panel 31; a left side panel 36 hinged to the left side 301 of the rear panel 30 and extending therefrom in a second transverse direction relative to the front and rear panels 32, 30, the left side panel 36 having a bottom side 361 abutting against the left side 313 of the bottom panel 31; a right side panel 37 hinged to the right side 302 of the rear panel 30 and extending therefrom in the second transverse direction, the right side panel 37 having a bottom side 371 abutting against the right side 314 of the bottom panel 31; a first left reinforcing panel 38 hinged to the bottom side 361 of the left side panel 36 and extending therefrom in a third transverse direction relative to the left side panel 36 to lie against the left portion 311 of the bottom panel 31, the first left reinforcing panel 38 having a free end 383 that is opposite to the left side 313 of the bottom panel 31; a first right reinforcing panel 38' hinged to the bottom side 371 of the right side panel 37 and extending therefrom in the third transverse direction to lie against the right portion 314 of the bottom panel 31, the first right reinforcing panel 38' having a free end 383' that is opposite to the right side 314 of the bottom panel 31 and that abuts against the free end 383 of the first left reinforcing panel 38; a top panel 33 hinged to the top side 303 of the rear panel 30 and extending therefrom in the second transverse direction; and an interlocking unit for securing the top panel 33 to the front panel 32 and the left and right side panels 36, 37.

Figure 8:
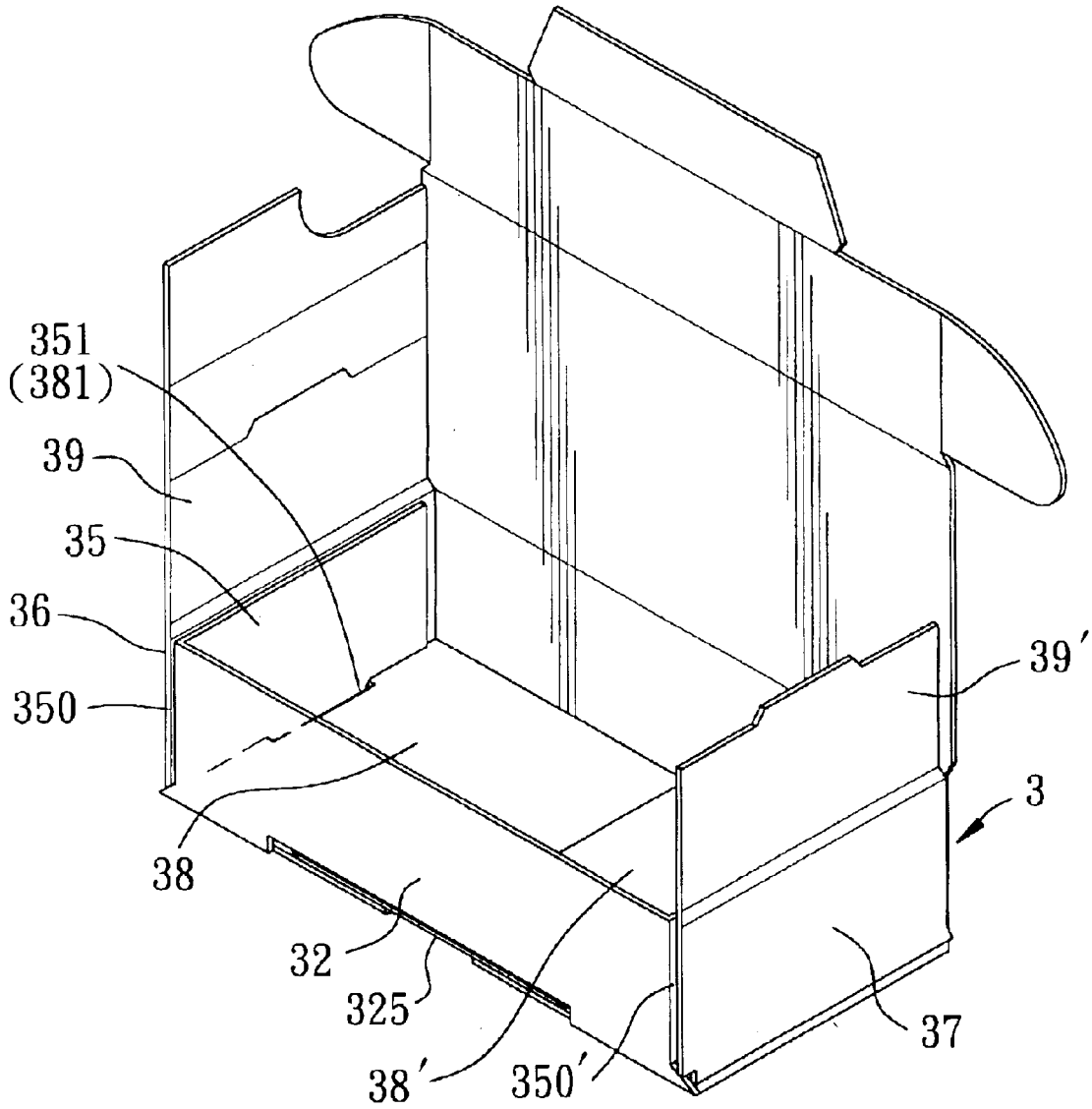
FIG. 8 is a perspective view to illustrate how another pair of reinforcing panels are folded to abut against respectively left and right side panels of the box of FIG. 4.
Figure 9:
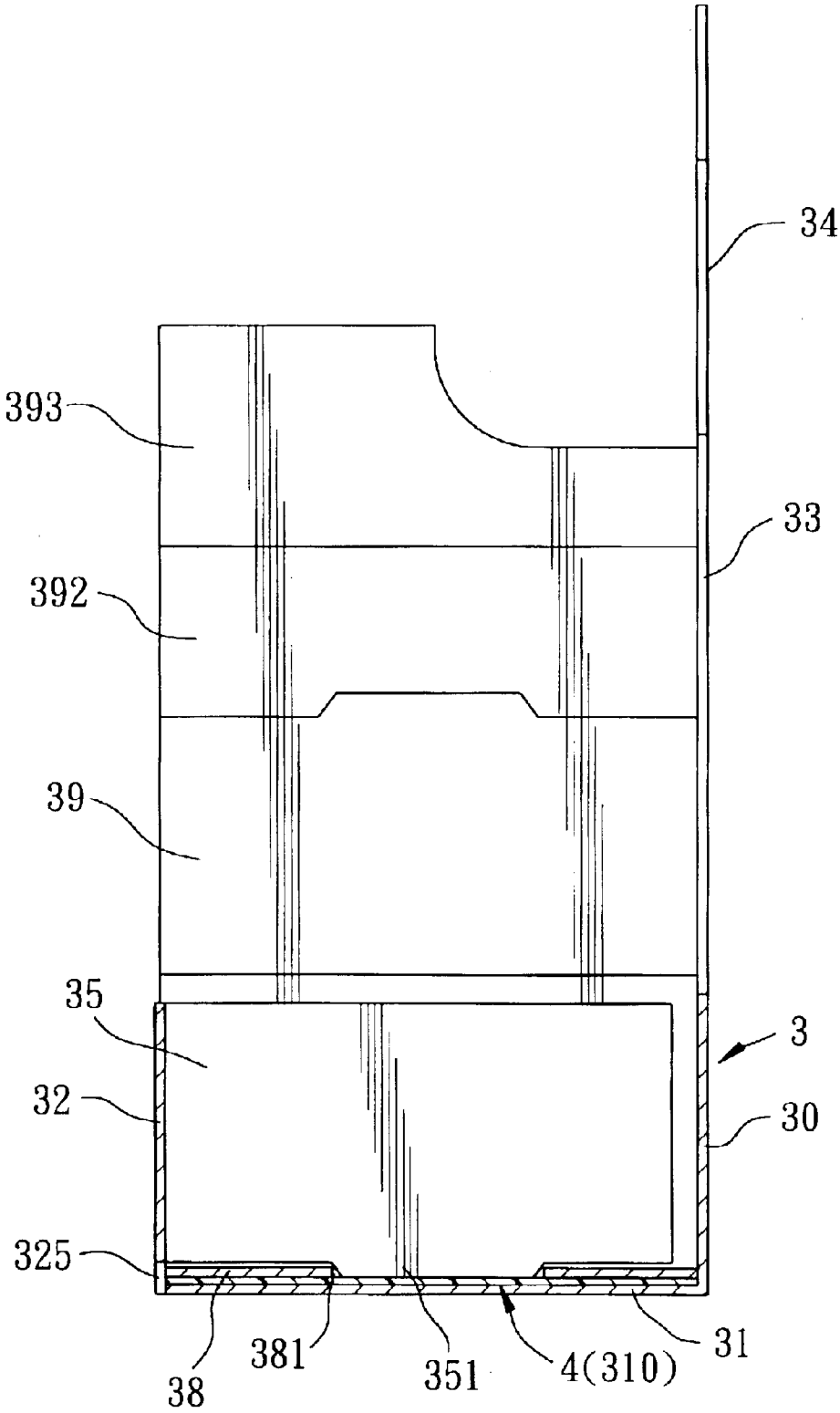
FIG. 9 is a sectional side view of FIG. 8.

Referring to FIGS. 8 and 9, in combination with FIG. 5, the front panel 32 has left and right sides 321, 322. The box 3 further includes a second left reinforcing panel 35 hinged to the left side 321 of the front panel 32 and extending therefrom in the second transverse direction to lie against the left side 313 of the bottom panel 31 and to dispose adjacent to and to confront the left side panel 36, and a second right reinforcing panel 35' hinged to the right side 322 of the front panel 32 and extending therefrom in the second transverse direction to lie against the right side 314 of the bottom panel 31 and to dispose adjacent to and to confront the right side panel 37.

Figure 10:
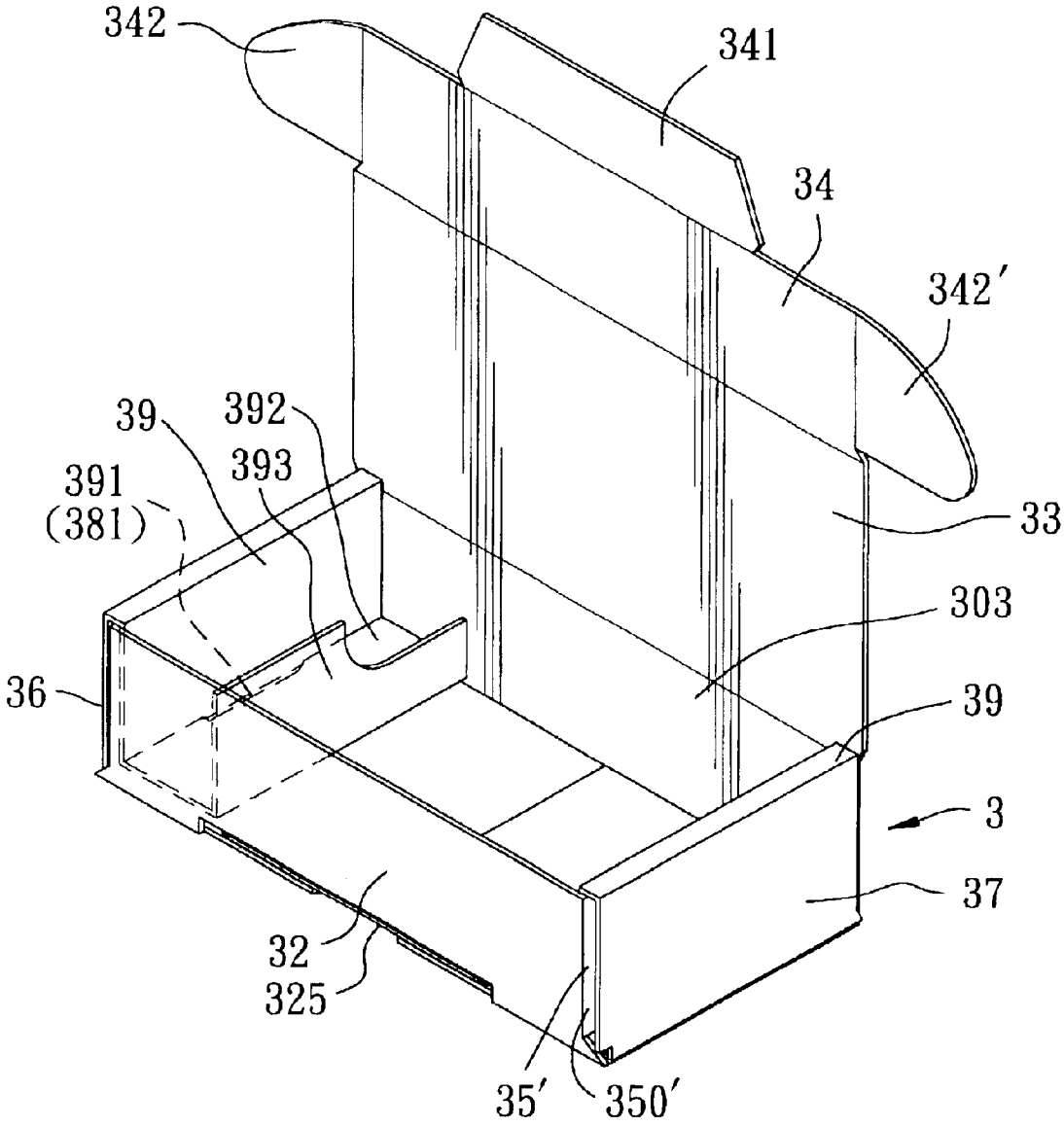
FIG. 10 is a perspective view to illustrate how yet another pair of reinforcing panels are folded to abut against respectively the reinforcing panels of FIG. 8.
Figure 11:
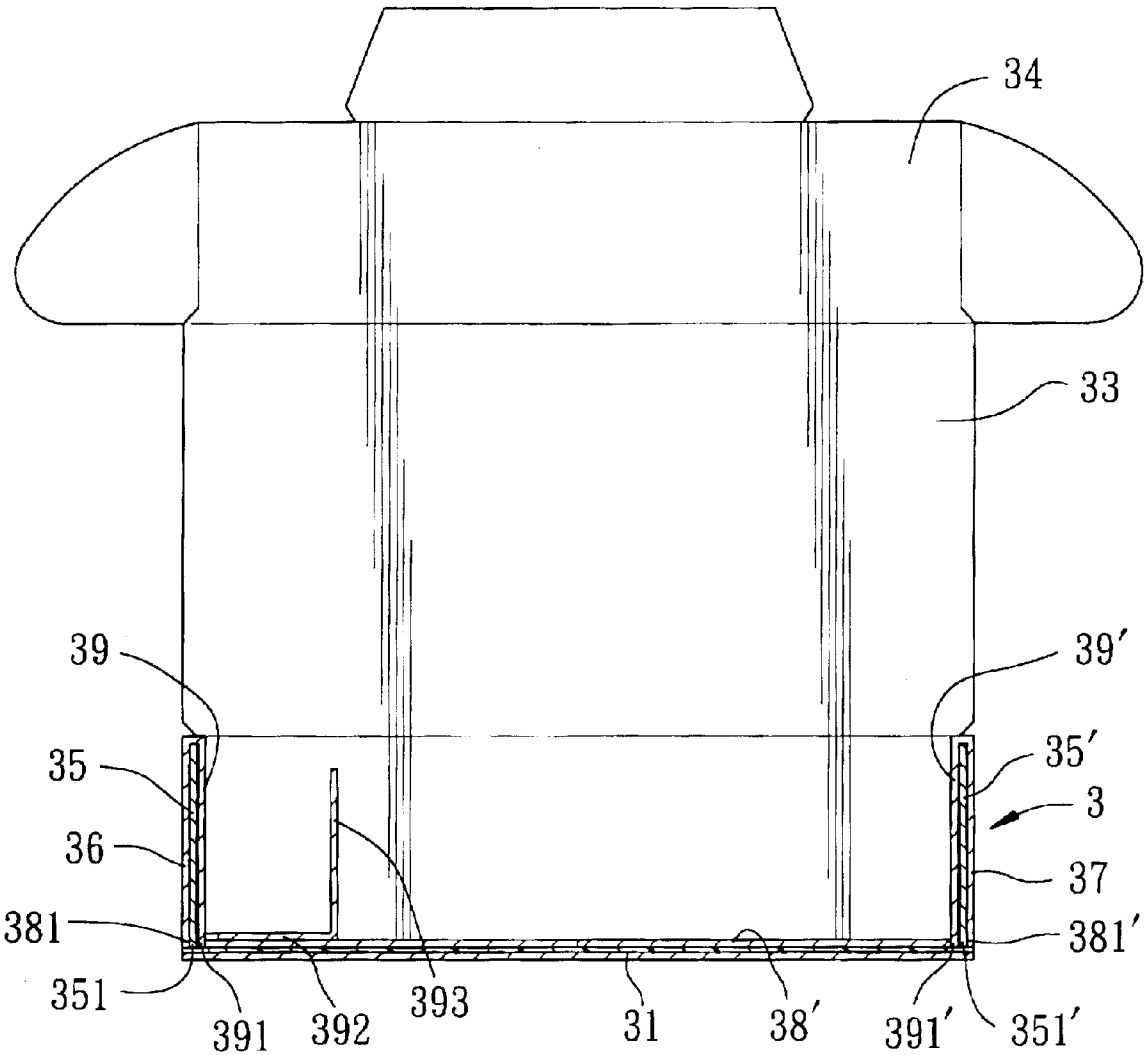
FIG. 11 is a sectional front view of FIG. 10.

Referring to FIGS. 10 and 11, in combination with FIG. 5, the left side panel 36 has a top side 362 that is opposite to the bottom side 361 of the left side panel 36. The right side panel 37 has a top side 372 that is opposite to the bottom side 371 of the right side panel 37. The box 3 further includes a third left reinforcing panel 39 that is hinged to the top side 362 of the left side panel 36 and that extends therefrom in the first transverse direction to dispose adjacent to and to confront the second left reinforcing panel 35, and a third right reinforcing panel 39' that is hinged to the top side 372 of the right side panel 37 and that extends therefrom in the first transverse direction to dispose adjacent to and to confront the second right reinforcing panel 35'. Each of the third left and right reinforcing panels 39, 39' has a width in the second transverse direction that is substantially equal to that of each of the left and right side panels 36, 37.

Referring to FIG. 8, in combination with FIG. 5, the first left reinforcing panel 38 has a left end that is opposite to the free end 383 of the first left reinforcing panel 38 and that is formed with a left retaining groove 381. The first right reinforcing panel 38' has a right end that is opposite to the free end 383' of the first right reinforcing panel 38' and that is formed with a right retaining groove 381'. The second left reinforcing panel 35 has a bottom side that is formed with a first left retaining tongue 351 which extends into the left retaining groove 381. The second right reinforcing panel 35' has a bottom side that is formed with a first right retaining tongue 351' which extends into the right retaining groove 381'.

Referring to FIG. 10, in combination with FIG. 5, the third left reinforcing panel 39 has a bottom side that is formed with a second left retaining tongue 391 which extends into the left retaining groove 381. The third right reinforcing panel 39' has a bottom side that is formed with a second right retaining tongue 391' which extends into the right retaining groove 381'.

Referring to FIG. 10, in combination with FIG. 5, the box 3 further includes a fourth reinforcing panel 392 hinged to the bottom side of the third left reinforcing panel 39 and extending therefrom in the third transverse direction to lie against a portion of the first left reinforcing panel 38, and a partition panel 393 hinged to the fourth reinforcing panel 392 and extending therefrom in the first transverse direction. The partition panel 393 divides an inner space of the box 3 into two parts for storing different sizes of pieces of a product.

Figure 12:
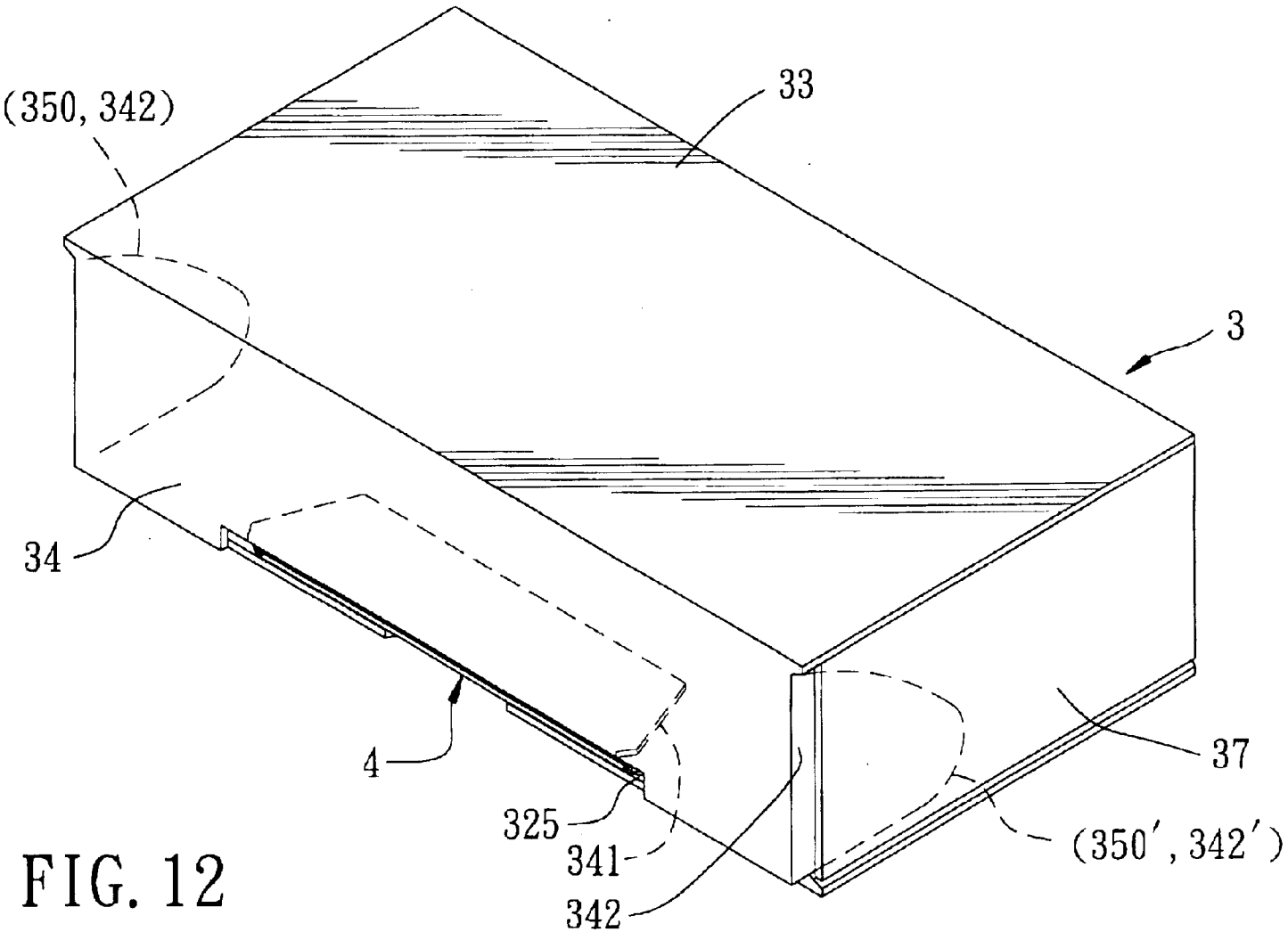
FIG. 12 is a perspective view to illustrate how an interlocking unit extends into a slit and left and right gaps and how a hanging member is movably received in a bottom gap.
Figure 13:
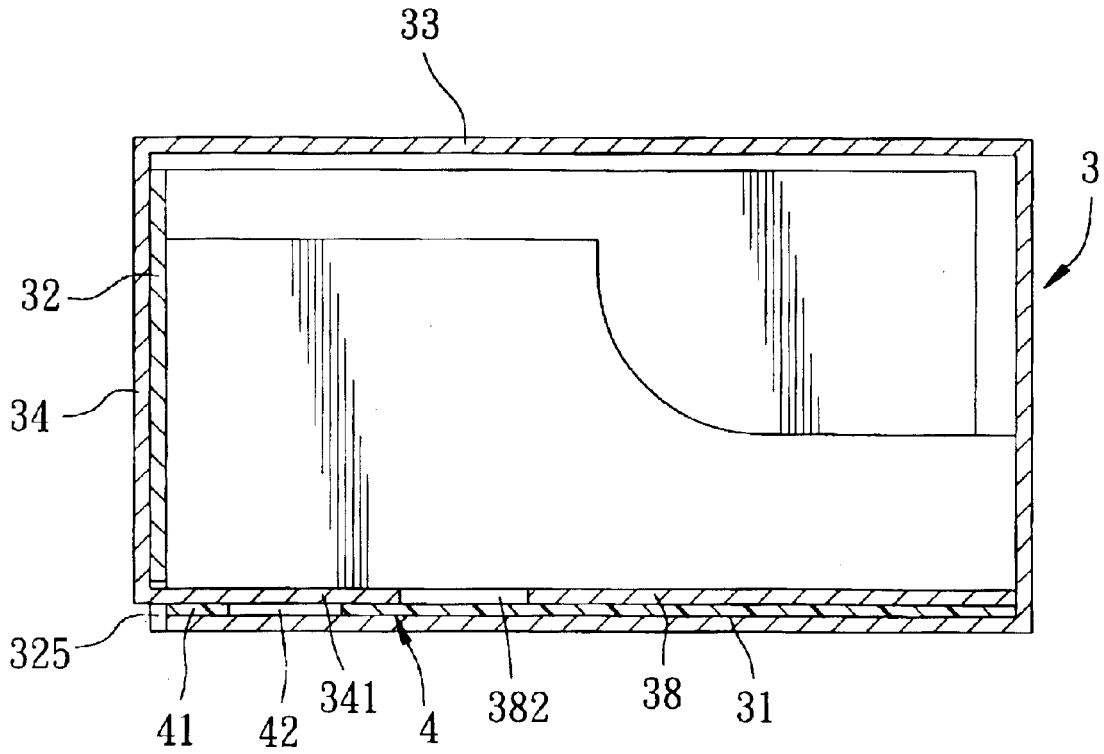
FIG. 13 is a sectional view of FIG. 12 with the hanging member shown in a retracted state.
Figure 14:
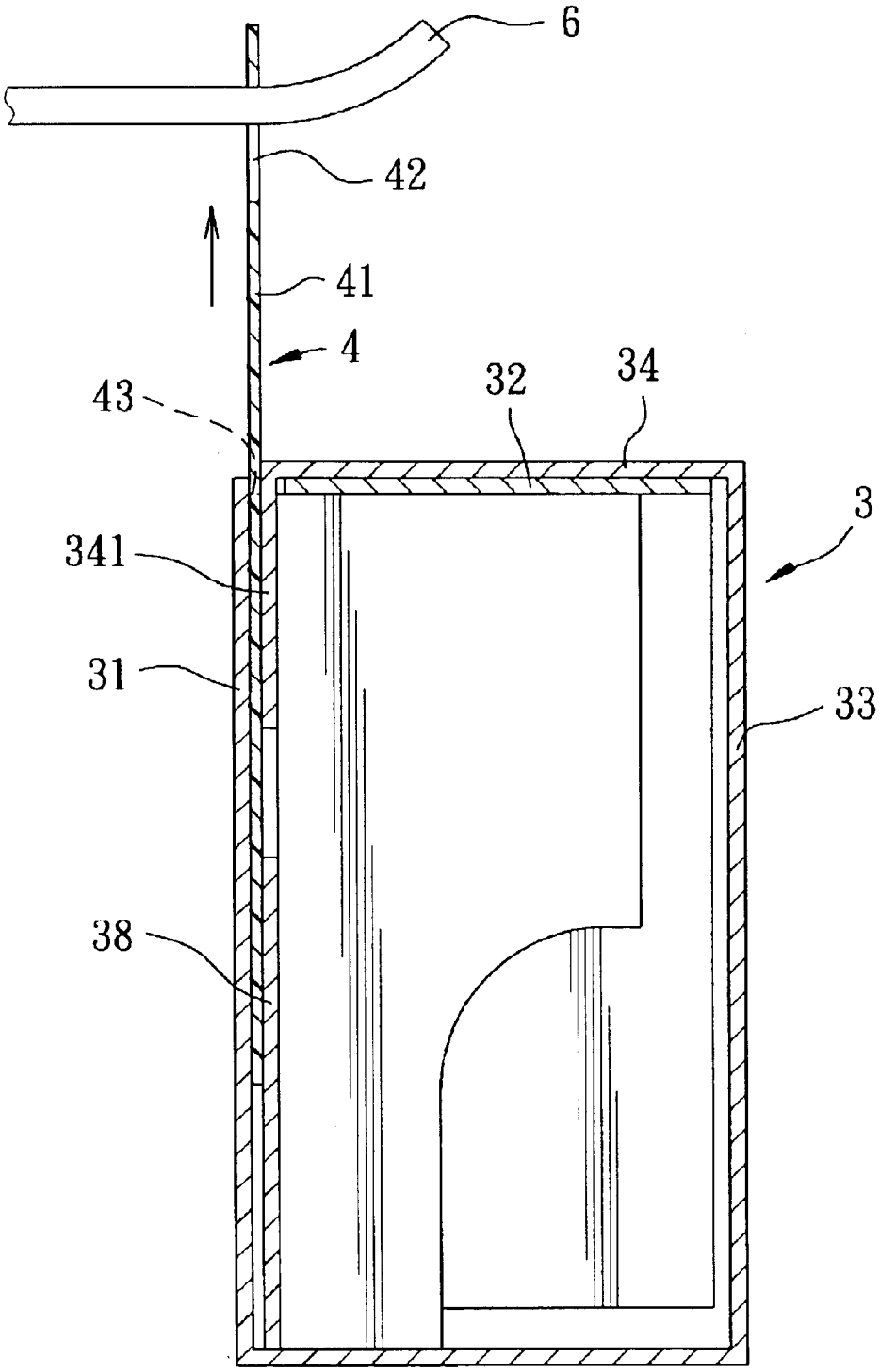
FIG. 14 is a sectional view of FIG. 12 with the hanging member shown in an extended state.

Referring to FIG. 12, in combination with FIG. 5, the front panel 32 further has a top side 323 and a bottom side 324 that is hinged to the front side 315 of the bottom panel 31 and that is formed with a slit 325. The free ends 383, 383' of the first left and right reinforcing panels 38, 38' are formed with receiving recesses 382 that are in spatial communication with the slit 325. The top panel 33 has a front side 331 that lies against the top side 323 of the front panel 32. The box 3 further includes a front reinforcing panel 34 that has a bottom side 343 and a top side 344 hinged to the front side 331 of the top panel 33 and extending therefrom in the first transverse direction to dispose adjacent to and to confront the front panel 32. The interlocking unit includes a front-retaining tongue 341 that is hinged to the bottom side 343 of the front reinforcing panel 34 and that extends therefrom through the slit 325 and into the receiving recesses 382. The front retaining tongue 341 has a size sufficient to span the recesses 382. The front reinforcing panel 34 has left and right sides. The second left reinforcing panel 35 is spaced apart from the left side panel 36 by a left gap 350. The second right reinforcing panel 35' is spaced apart from the right side panel 37 by a right gap 350'. The interlocking unit further includes a left wing panel 342 hinged to the left side of the front reinforcing panel 34 and extending therefrom into the left gap 350, and a right wing panel 342' hinged to the right side of the front reinforcing panel 34 and extending therefrom into the right gap 350'.

Referring back to FIGS. 5 and 6, in combination with FIG. 12, the first left and right reinforcing panels 38, 38' are spaced apart from the bottom panel 31 by a bottom gap 310. The box 3 further includes a hanging member 4 that has a retaining portion 43 and a hanging portion 41 reduced from the retaining portion 43, and that is movably received in the bottom gap 310 between an extended position (see FIG. 14), in which the hanging portion 41 extends outwardly through the slit 325 and in which the retaining portion 43 abuts against the bottom side 324 of the front panel 32, and a retracted position (see FIG. 13), in which the hanging portion 41 is received in the bottom gap 310. A through-hole 42 is formed in the hanging portion 41 of the hanging member 4 for extension of a string 6 therethrough. The hanging member 4 includes a transparent sheet that is folded into two overlapping halves which form a receiving space 400 therebetween for receiving a label 5 therein.

The strength of the box 3 of this invention is enhanced at the bottom side thereof by the first left and right reinforcing panels 38, 38', at left and right sides thereof by the second and third left and right reinforcing panels 35, 35', 39, 39', and at the front side thereof by the front reinforcing panel 34, thereby eliminating the aforesaid drawback as encountered in the prior art. Moreover, the hanging member 4 cab be retracted into the bottom gap 310 to facilitate storing and transport of the box 3 of this invention.

With the invention thus explained, it is apparent that various modifications and variations can be made without departing from the spirit of the present invention. It is therefore intended that the invention be limited only as recited in the appended claims.

I claim:

1. A box formed from a blank sheet, said blank sheet being cut and scored and being folded into said box, said box comprising:

a bottom panel with left and right sides and front and rear sides, said bottom panel having left and right portions;

a front panel hinged to said front side of said bottom panel and extending therefrom in a first transverse direction relative to said bottom panel;

a rear panel hinged to said rear side of said bottom panel, extending therefrom in said first transverse direction, and having left and right sides and a top side that is opposite to said rear side of said bottom panel;

a left side panel hinged to said left side of said rear panel and extending therefrom in a second transverse direction relative to said front and rear panels, said left side panel having a bottom side abutting against said left side of said bottom panel;

a right side panel hinged to said right side of said rear panel and extending therefrom in said second transverse direction, said right side panel having a bottom side abutting against said right side of said bottom panel;

a first left reinforcing panel hinged to said bottom side of said left side panel and extending therefrom in a third transverse direction relative to said left side panel to lie against said left portion of said bottom panel, said first left reinforcing panel having a free end that is opposite to said left side of said bottom panel;

a first right reinforcing panel hinged to said bottom side of said right side panel and extending therefrom in said third transverse direction to lie against said right portion of said bottom panel, said first right reinforcing panel having a free end that is opposite to said right side of said bottom panel and that abuts against said free end of said first left reinforcing panel; a top panel hinged to said top side of said rear panel and extending therefrom in said second transverse direction; and an interlocking unit for securing said top panel to said front panel and said left and right side panels.

wherein said front panel has left and right sides, said box further comprising a second left reinforcing panel hinged to said left side of said front panel and extending therefrom in said second transverse direction to lie against said left side of said bottom panel and to dispose adjacent to and to confront said left side panel, and a second right reinforcing panel hinged to said right side of said front panel and extending therefrom in said second transverse direction to lie against said right side of said bottom panel and to dispose adjacent to and to confront said right side panel.

wherein said left side panel has a top side that is opposite to said bottom side of said left side panel, said right side panel having a top side that is opposite to said bottom side of said right side panel, said box further comprising a third left reinforcing panel that is hinged to said top side of said left side panel and that extends therefrom in said first transverse direction to dispose adjacent to and to confront said second left reinforcing panel, and a third right reinforcing panel that is hinged to said top side of said right side panel and that extends therefrom in said first transverse direction to dispose adjacent to and to confront said second right reinforcing panel, wherein said first left reinforcing panel has a left end that is opposite to said free end of said first left reinforcing panel and that is formed with a left retaining groove, said first right reinforcing panel having a right end that is opposite to said free end of said first right reinforcing panel and that is formed with a right retaining groove, said second left reinforcing panel having a bottom side that is formed with a first left retaining tongue which extends into said left retaining groove, said second right reinforcing panel having a bottom side that is formed with a first right retaining tongue which extends into said right retaining groove, wherein said third left reinforcing panel has a bottom side that is formed with a second left retaining tongue which extends into said left retaining groove, said third right reinforcing panel having a bottom side that is formed with a second right retaining tongue which extends into said right retaining groove.

said box further comprising a fourth reinforcing panel hinged to said bottom side of said third left reinforcing panel and extending therefrom in said third transverse direction to lie against a portion of said first left reinforcing panel, and a partition panel hinged to said fourth reinforcing panel and extending therefrom in said first transverse direction, wherein said front panel further has a top side and a bottom side that is hinged to said front side of said bottom panel and that is formed with a slit, said free ends of said first left and right reinforcing panels being formed with receiving recesses that are in spatial communication with said slit, said top panel having a front side that lies against said top side of said front panel, said box further comprising a front reinforcing panel that has a bottom side and a top side hinged to said front side of said top panel and extending therefrom in said first transverse direction to dispose adjacent to and to confront said front panel, said interlocking unit including a front retaining tongue that is hinged to said bottom side of said front reinforcing panel and that extends therefrom through said slit and into said receiving recesses.

2. The box of claim 1, wherein said front retaining tongue has a size sufficient to span said recesses.

3. The box of claim 1, wherein said front reinforcing panel has left and right sides, said second left reinforcing panel being spaced apart from said left side panel by a left gap, said second right reinforcing panel being spaced apart from said right side panel by a right gap, said interlocking unit further including a left wing panel hinged to said left side of said front reinforcing panel and extending therefrom into said left gap, and a right wing panel hinged to said right side of said front reinforcing panel and extending therefrom into said right gap.

4. The box of claim 3, wherein said first left and right reinforcing panels are spaced apart from said bottom panel by a bottom gap, said box further comprising a hanging member that has a retaining portion and a hanging portion reduced from said retaining portion, and that is movably received in said bottom gap between an extended position, in which said hanging portion extends outwardly through said slit and in which said retaining portion abuts against said bottom side of said front panel, and a retracted position, in which said hanging portion is received in said bottom gap.

* * * * *